US009099769B2

(12) United States Patent
Yi

(10) Patent No.: US 9,099,769 B2
(45) Date of Patent: Aug. 4, 2015

(54) ANTENNA MECHANICAL FACEPLATE DESIGN

(71) Applicant: Cisco Technology, Inc., San Jose, CA (US)

(72) Inventor: George Youzhi Yi, Fremont, CA (US)

(73) Assignee: Cisco Technology, Inc., San Jose, CA (US)

( * ) Notice: Subject to any disclaimer, the term of this patent is extended or adjusted under 35 U.S.C. 154(b) by 284 days.

(21) Appl. No.: 13/833,301

(22) Filed: Mar. 15, 2013

(65) Prior Publication Data

US 2014/0268626 A1 Sep. 18, 2014

(51) Int. Cl.
*H01R 9/00* (2006.01)
*H01Q 1/12* (2006.01)

(52) U.S. Cl.
CPC ..... *H01Q 1/12* (2013.01)

(58) Field of Classification Search
USPC ..... 361/823, 799, 816, 818, 807, 809, 810
See application file for complete search history.

(56) References Cited

U.S. PATENT DOCUMENTS

| | | | | |
|---|---|---|---|---|
| 5,764,265 | A * | 6/1998 | Minegishi et al. | 347/108 |
| 6,269,162 | B1 * | 7/2001 | McMillan | 379/438 |
| 7,606,044 | B2 * | 10/2009 | Bailey et al. | 361/752 |
| 8,322,768 | B2 * | 12/2012 | Carnevali | 296/24.34 |
| 2005/0200284 | A1 * | 9/2005 | Thompson et al. | 315/56 |
| 2010/0171830 | A1 * | 7/2010 | Lee | 348/148 |

* cited by examiner

*Primary Examiner* — Hung S Bui
(74) *Attorney, Agent, or Firm* — Merchant & Gould P.C.

(57) ABSTRACT

A faceplate configured for attachment to a communications module may be provided. The faceplate may comprise a first surface arranged in a vertical direction relative to the chassis and a second surface arranged at an angle to the first surface. The second surface may comprise a connector for attachment to another piece of equipment, such as an antenna.

18 Claims, 5 Drawing Sheets

ANTENNA MECHANICAL FACEPLATE DESIGN

TECHNICAL FIELD

The present disclosure relates generally to the design of communications equipment modules.

BACKGROUND

An antenna (or aerial) is an electrical device which converts electric power into radio waves, and vice versa. It is usually used with a radio transmitter or radio receiver. In transmission, a radio transmitter supplies an oscillating radio frequency electric current to the antenna's terminals, and the antenna radiates the energy from the current as electromagnetic waves (radio waves). In reception, an antenna intercepts some of the power of an electromagnetic wave in order to produce a tiny voltage at its terminals that is applied to a receiver to be amplified.

Antennas are essential components of all equipment that uses radio. They are used in systems such as radio broadcasting, broadcast television, two-way radio, communications receivers, radar, cell phones, and satellite communications, as well as other devices such as garage door openers, wireless microphones, bluetooth enabled devices, wireless computer networks, baby monitors, and RFID tags on merchandise.

Typically an antenna consists of an arrangement of metallic conductors ("elements"), electrically connected (often through a transmission line) to the receiver or transmitter. An oscillating current of electrons forced through the antenna by a transmitter will create an oscillating magnetic field around the antenna elements, while the charge of the electrons also creates an oscillating electric field along the elements. These time-varying fields, when created in the proper proportions, radiate away from the antenna into space as a moving transverse electromagnetic field wave. Conversely, during reception, the oscillating electric and magnetic fields of an incoming radio wave exert force on the electrons in the antenna elements, causing them to move back and forth, creating oscillating currents in the antenna.

An antenna faceplate for a communication module may be provided. Conventional faceplates for rack-insertable communication modules comprise a vertical surface to which additional equipment, such as antennas are mounted. However, these arrangements fail to dissipate enough heat to satisfy some manufacturer's specifications. Furthermore, the flat panel design results in attachments that interfere with the cabling to and from other modules.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Overview

Figure 1:
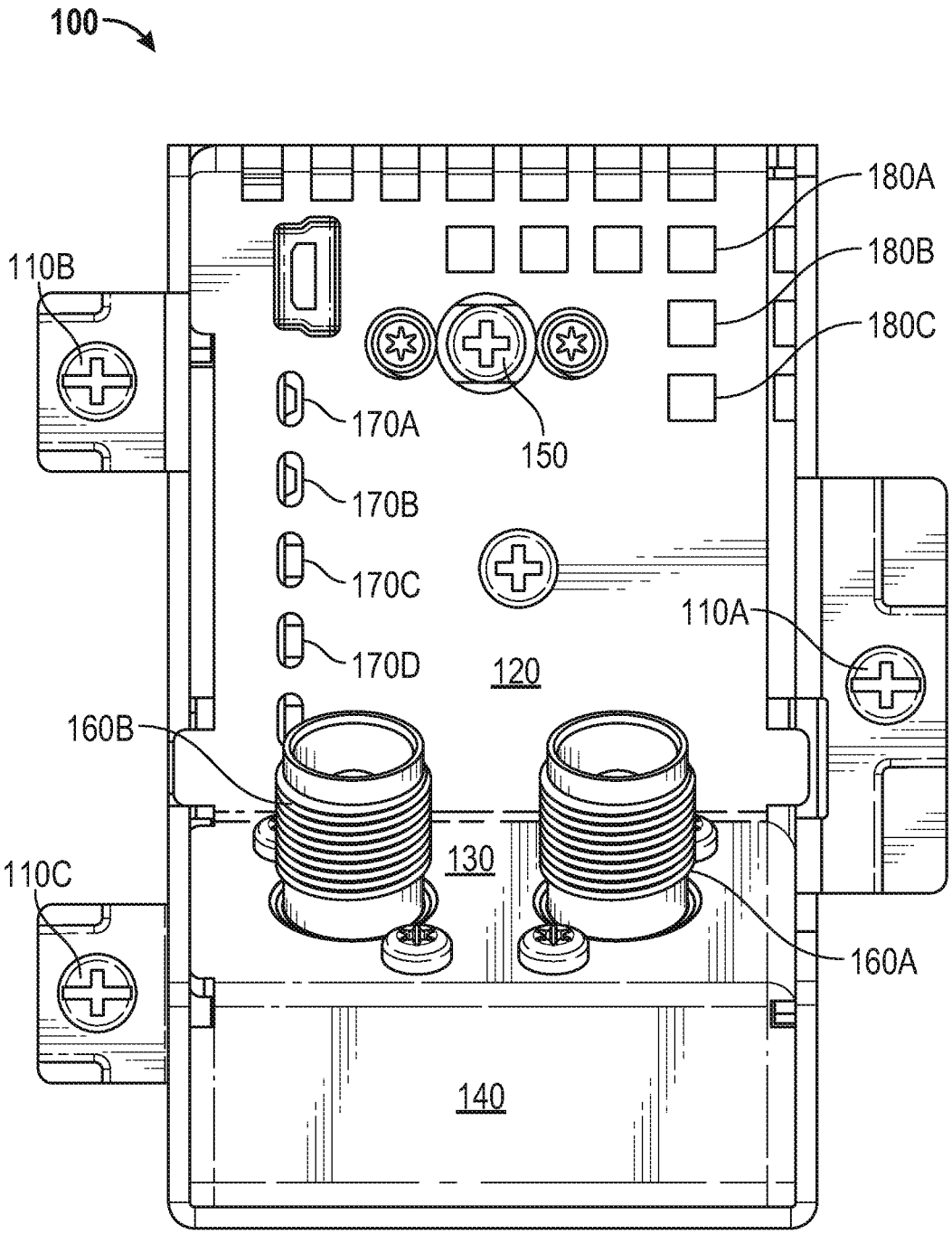
FIG. 1 is a front elevation view of an antenna faceplate.

Consistent with embodiments of the present disclosure, systems and methods are disclosed for user terminal location.

A faceplate configured for attachment to a communications module may be provided. The faceplate may comprise a first surface arranged in a vertical direction relative to the chassis and a second surface arranged at an angle to the first surface. The second surface may comprise a connector for attachment to another piece of equipment, such as an antenna.

It is to be understood that both the foregoing general description and the following detailed description are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the detailed description.

Example Embodiments

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Embodiments of the disclosure may comprise a faceplate. The faceplate may operate, for example, in the smart grid environment (e.g. −40 C to 85 C). A fan may not be allowed for cooling. Consequently, heat may be dissipated, for example, through an external surface that may be a front panel. The front panel may not include enough surface area and may further be covered by other antenna connectors. Conventional flat panel design failed to dissipate sufficient amounts of heat.

Embodiments of the disclosure may include connectors for antennas mount on, for example, a 30 degree faceplate. Installed antennas positioned with 30 degree angle from the faceplate may avoid interfering with cablings from other rack units. This angled faceplate design may resolve the cooling and antenna interference issues while keeping the overall depth the same as conventional panel designs, for example.

FIG. 1 is a front elevation view of an antenna faceplate 100. Antenna faceplate 100 may comprise a plurality of connection points 110(A)-(C) for mounting to a chassis, such as a rack-mountable equipment chassis 500, discussed in more detail below with respect to FIG. 5. Antenna faceplate 100 may comprise a first surface 120, a second surface 130, and a third surface 140. First surface 120 and third surface 140 may be arranged such that they are vertically oriented and substantially parallel to each other. Second surface 130 may be situated at an angle relative to first surface 120 and third surface 140. Each surface 120, 130, and 140 may be configured to provide one and/or more connection point(s) to additional pieces of equipment, such as an accessory connector 150 on first surface 120 and a plurality of primary connectors 160 (A)-(B) on second surface 130. Antenna faceplate 100 may also comprise additional features such as a plurality of indicator lights 170(A)-(D) and/or a plurality of vent holes 180 (A)-(C). Antenna faceplate 100 may be fabricated from a material selected for its heat dissipation properties, such as aluminum.

Figure 2:
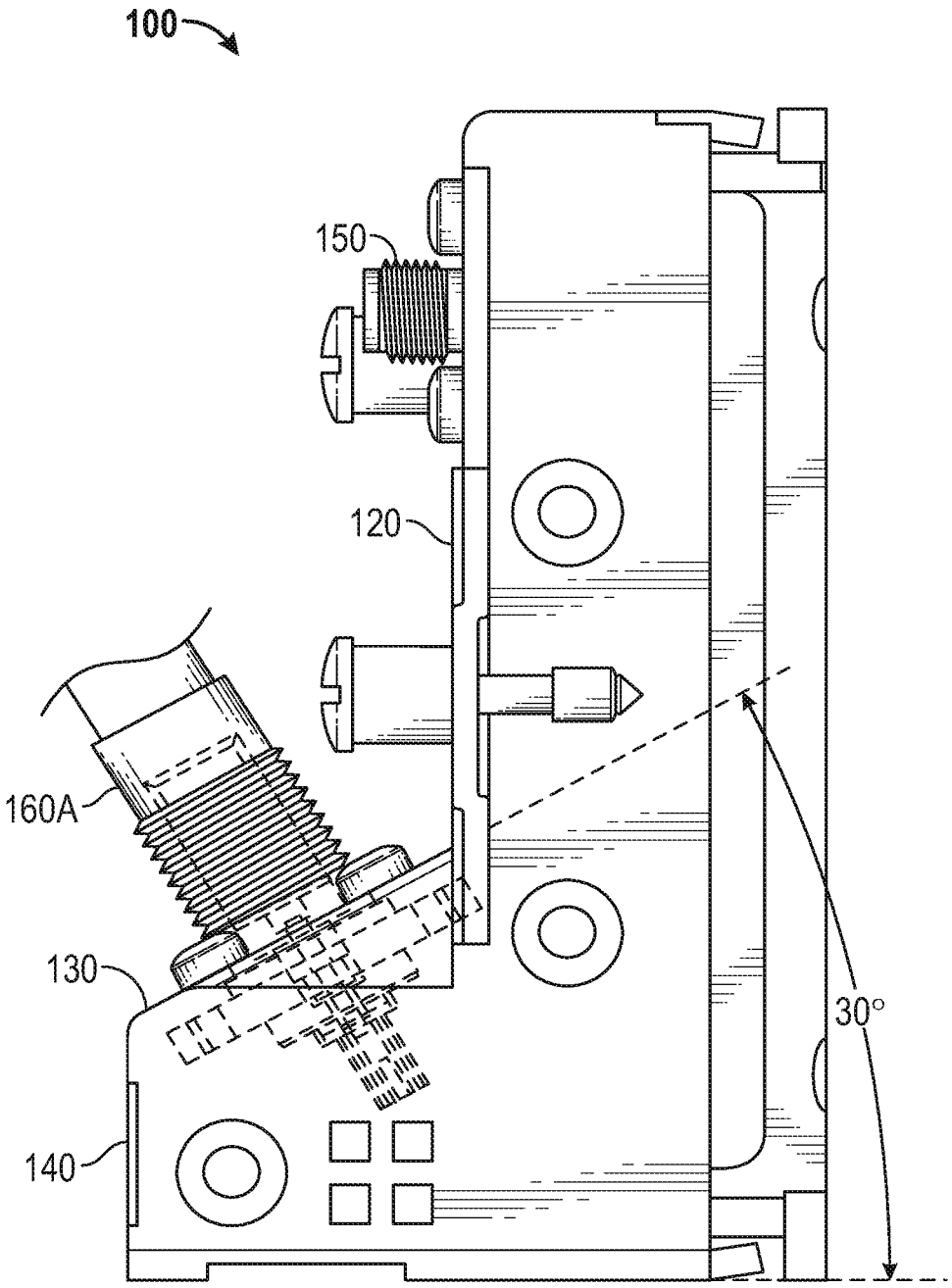
FIG. 2 is a side elevation view of the antenna faceplate.

FIG. 2 is a side elevation view of antenna faceplate 100 illustrating the angle of second surface 130 relative to first surface 120 and third surface 140. In this illustration, second surface 130 is arranged at 30° relative to a horizontal plane perpendicular to the vertical orientation of first surface 120 and third surface 140. This angle may vary, and may be selected according to various factors. These factors may comprise minimizing interference between primary connectors 160(A)-(B) and accessory connector 150 and/or minimizing interference between any attachments to any connectors on any of surfaces 120, 130, and 140. Further, the design of the vertical and angled surfaces may operate to extend a heat dissipation area for the module, improving the thermal characteristics over the limited efficiency of an internal heat sink (not shown). The internal heat sink may be attached to the front surface so that heat is conducted from heat sources inside the module through the heat sink and to the faceplate for dissipation into the environment. The depth of third surface 140 may be selected to match the depth of primary connectors 160(A)-(B) as if they were mounted on first surface 120. For example, in the example illustrated by FIG. 2, the depth of third surface 140 is approximately 0.9", which is approximately equivalent to the exposed length of a threaded Neill-Concelman (TNC) connector when mounted horizontally.

Figure 3:
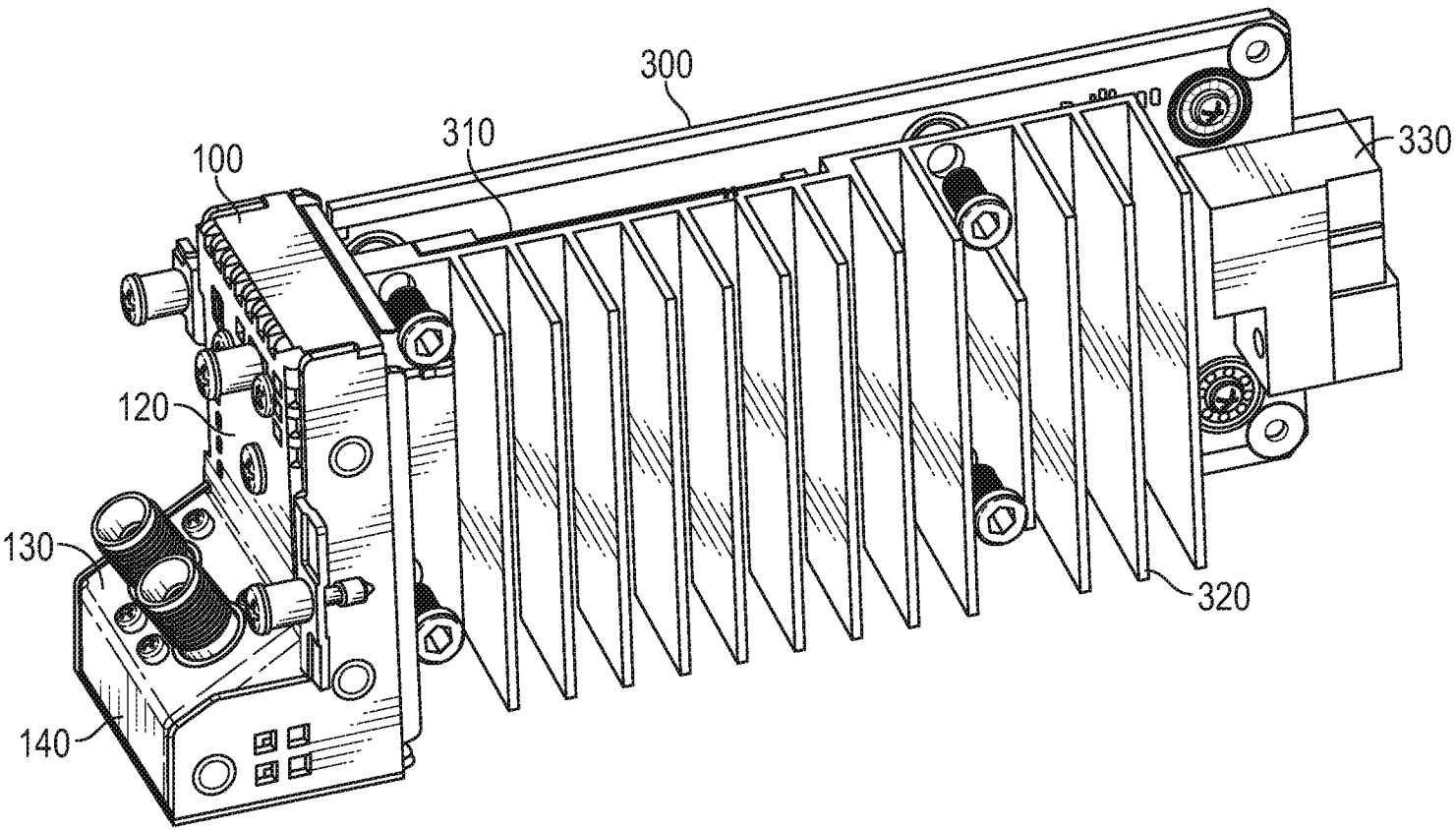
FIG. 3 is an auxiliary view of the antenna faceplate coupled to a communications module.

FIG. 3 is an auxiliary view of antenna faceplate 100 coupled to a communications module 300. Communications module 300 may comprise equipment such as a printed circuit board (PCB) 310, a heat sink 320, and a connector 330 for communicatively coupling to rack-mountable equipment chassis 500.

Figure 4:
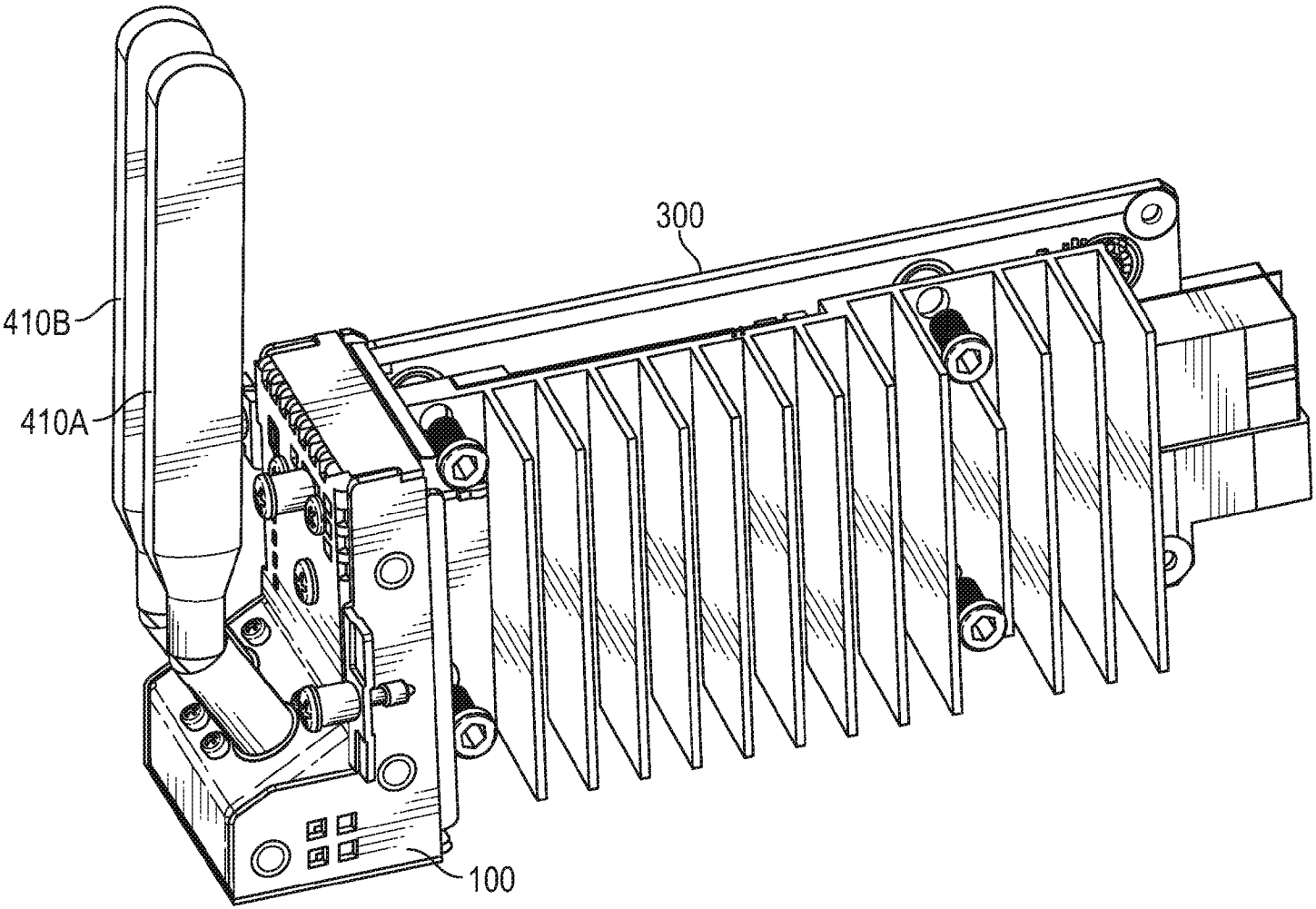
FIG. 4 is a second auxiliary view of the antenna faceplate and the communications module with an attached pair of antennas.

FIG. 4 is a second auxiliary view of antenna faceplate 100 and communications module 300 with an attached pair of antennas 410(A)-(B). In this example, primary connectors 160(A)-(B) comprise TNC connectors coupled to LTE antennas.

Figure 5:
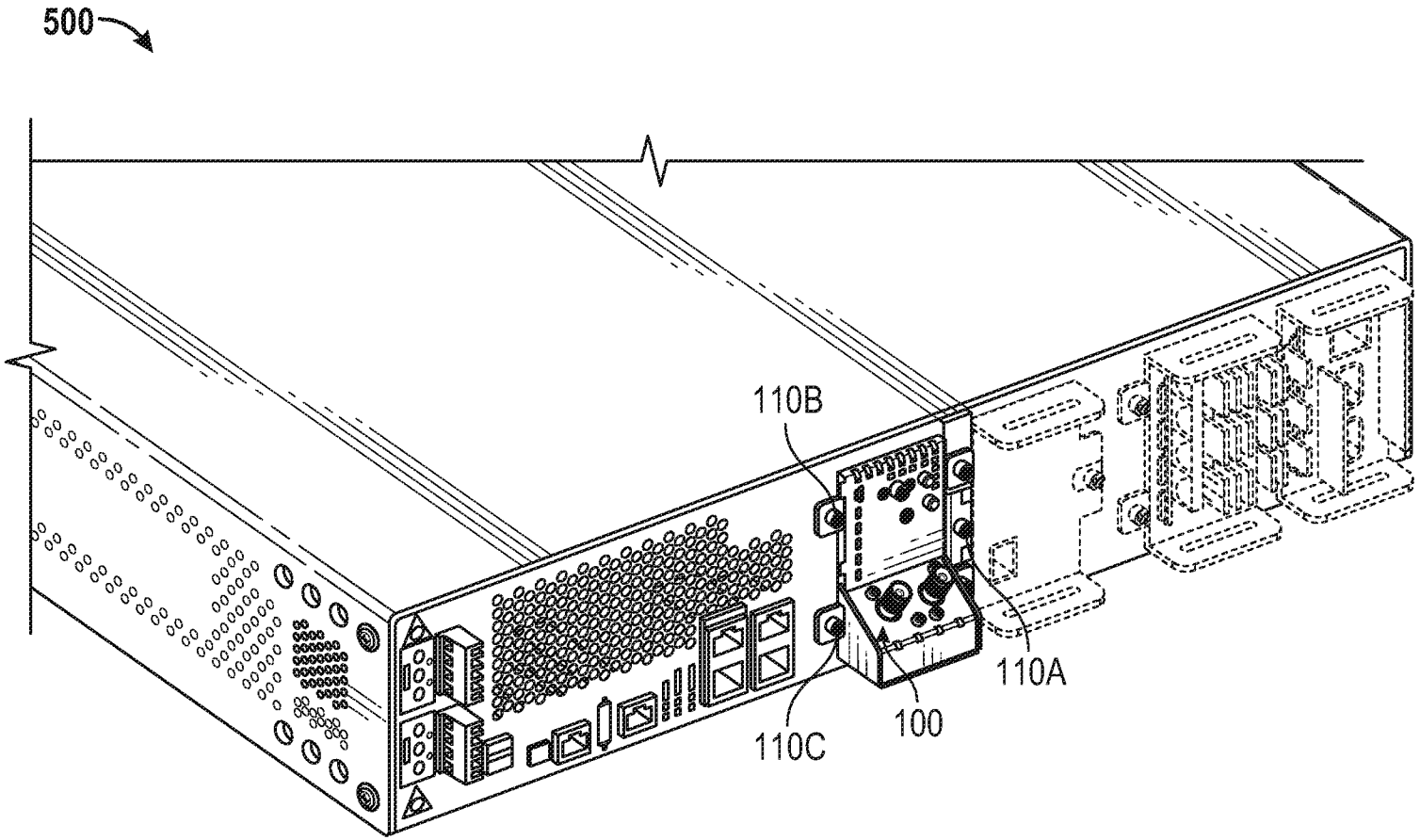
FIG. 5 is an auxiliary view of the communications module coupled to a rack-mountable equipment chassis.

FIG. 5 is an auxiliary view of communications module 300 coupled to rack-mountable equipment chassis 500 with antenna faceplate 100 exposed.

Consistent with embodiments of the disclosure, an apparatus may be provided. The apparatus may comprise a faceplate configured for attachment to a communications module. The faceplate may comprise a first surface arranged in a vertical direction relative to the chassis and a second surface arranged at an angle to the first surface.

Consistent with other embodiments of the disclosure, an apparatus may be provided. The apparatus may comprise a faceplate configured for attachment to a chassis. The faceplate may comprise a first vertical surface, a second vertical surface, and a third surface arranged at an angle between the first vertical surface and the second vertical surface.

Consistent with yet other embodiments of the disclosure, an apparatus may be provided. The apparatus may comprise a faceplate for a communications module. The faceplate may comprise a first surface arranged at a non-vertical angle from a horizontal plane. The first surface may comprise at least one antenna connector.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the disclosure.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. An apparatus comprising:

a faceplate configured for attachment to a communications module, wherein the faceplate comprises a first surface arranged in a vertical direction relative to the chassis and a second surface arranged at an angle to the first surface wherein the second surface comprises at least one primary connector and wherein the angle is selected to increase available cabling space between the at least one primary connector and the first surface.

2. The apparatus of claim 1, wherein the communications module is configured for coupling to a rack-mounted equipment chassis.

3. The apparatus of claim 1, wherein the first surface comprises at least one accessory connector.

4. The apparatus of claim 3, wherein the accessory connector comprises a GPS connector.

5. The apparatus of claim 1, wherein the angle between the first surface and the second surface is selected to minimize interference between the accessory connector of the first surface and the at least one primary connector of the second surface.

6. The apparatus of claim 1, wherein the at least one primary connector comprises an antenna connector.

7. The apparatus of claim 6, wherein the angle between the first surface and the second surface is further selected to minimize interference between the protrusion of the first surface and an antenna coupled to the antenna connector.

8. An apparatus comprising a faceplate configured for attachment to a chassis, wherein the faceplate comprises a first vertical surface, a second vertical surface, and a third surface arranged at an angle between the first vertical surface and the second vertical surface wherein the third surface comprises at least one primary connector and wherein the angle is selected to increase available cabling space between the at least one primary connector and the first surface.

9. The apparatus of claim 8, wherein the faceplate comprises at least one vent hole.

10. The apparatus of claim 9, wherein the at least one vent hole is situated on the second vertical surface.

11. The apparatus of claim 8, wherein the angle of the third surface comprises approximately thirty (30) degrees from horizontal.

12. The apparatus of claim 8, wherein a depth of the third surface comprises approximately one (1) inch.

13. The apparatus of claim 8, wherein the faceplate comprises a heat-dissipating material.

14. An apparatus comprising a faceplate for a communications module, wherein the faceplate comprises a first surface arranged at a non-vertical angle from a horizontal plane and wherein the first surface comprises at least one antenna connector wherein the non-vertical angle is selected to increase available cabling space between the at least one antenna connector and at least one vertical surface of the faceplate.

15. The apparatus of claim 14, wherein the non-vertical angle comprises thirty (30) degrees from the horizontal plane.

16. The apparatus of claim 14, wherein the at least one antenna connector comprises a Threaded Neill-Concelman (TNC) connector.

17. The apparatus of claim 14, wherein the faceplate comprises a plurality of vent holes.

18. The apparatus of claim 17, wherein the plurality of vent holes are located on a second surface.

* * * * *